United States Patent [19]

Hora

[11] Patent Number: 4,919,055

[45] Date of Patent: Apr. 24, 1990

[54] SWITCHING DEVICE FOR AN OVERHEAD CABLE TRANSPORT

[75] Inventor: Ferdinand Hora, Burgdorf, Switzerland

[73] Assignee: Von Roll Transportsysteme AG, Thun, Switzerland

[21] Appl. No.: 342,682

[22] Filed: Apr. 26, 1989

Related U.S. Application Data

[63] Continuation of Ser. No. 142,684, Jan. 11, 1988, abandoned.

[30] Foreign Application Priority Data

Jan. 20, 1987 [CH] Switzerland ..... 00196/87-9

[51] Int. Cl.[5] ..... E01B 25/26

[52] U.S. Cl. ..... 104/130; 104/103; 104/89; 104/96; 104/112; 105/150

[58] Field of Search ..... 104/103, 89, 93, 96, 104/97, 112, 118, 130; 105/148, 149.1, 150

[56] References Cited

U.S. PATENT DOCUMENTS

| | | | |
|---|---|---|---|
| 2,222,356 | 2/1939 | Nelles | 104/103 |
| 3,012,521 | 12/1961 | Lich | 104/118 |
| 3,999,730 | 12/1976 | Gonsalves et al. | 104/130 |
| 4,016,818 | 4/1977 | Ellzey | 104/103 |
| 4,037,541 | 7/1977 | Giesgler et al. | 104/118 |
| 4,089,270 | 5/1978 | Blake | 104/130 |
| 4,212,247 | 7/1980 | Lusk | 104/118 |
| 4,290,367 | 9/1981 | Bravse et al. | 104/130 |
| 4,646,646 | 3/1987 | Swilley | 104/130 |
| 4,671,183 | 6/1987 | Fujita et al. | 104/118 |

FOREIGN PATENT DOCUMENTS

| | | |
|---|---|---|
| 163642 | 12/1904 | Fed. Rep. of Germany . |
| 1146516 | 4/1963 | Fed. Rep. of Germany . |
| 1575761 | 7/1969 | France . |
| 371143 | 5/1960 | Switzerland . |
| 2133755 | 8/1984 | United Kingdom . |

*Primary Examiner*—Richard A. Bertsch

*Attorney, Agent, or Firm*—Cushman, Darby & Cushman

[57] ABSTRACT

The switching device which interconnects a substantially linear primary track with a curved branch track, wherein each such track possesses a travel rail and in a plane above each of the travel rails a guide track, comprises two pivotable or swivelable travel rail sections and a curved pivotable or swivelable guide rail section. The pivotable or swivelable travel rail sections are alternatively movable out of rest positions into travel positions in which such are located in recesses formed by stationary travel rail sections. The movable rail sections are mutually interconnected with one another and with an actuation rod by toggle levers or toggle joint structures and thus commonly actuatable. These toggle levers or toggle joint structures coact with abutments and enable locking the movable rail sections in their travel positions. The switching device affords quiet travel of the vehicles of the overhead cable transport installation and prevents derailing thereof.

28 Claims, 2 Drawing Sheets

2
6
4
III
9
46
16
25
II
27B
14
27B
27
26
28
29
12
3
7
30
30a
15
9a
30
11
24
19
18
17
21
22
20a
20
13
23
30
8a
8
1
30
7a
10
5
15a
30a
30

2
4
6
9
16
15
19
17
18
20
21
27B
27
14
26
28
27a
IV
12
10
9a
30a
11
30a
13
23
22
30a
8a
3
29
7
30
47
30
30
30
8
1
5
IV

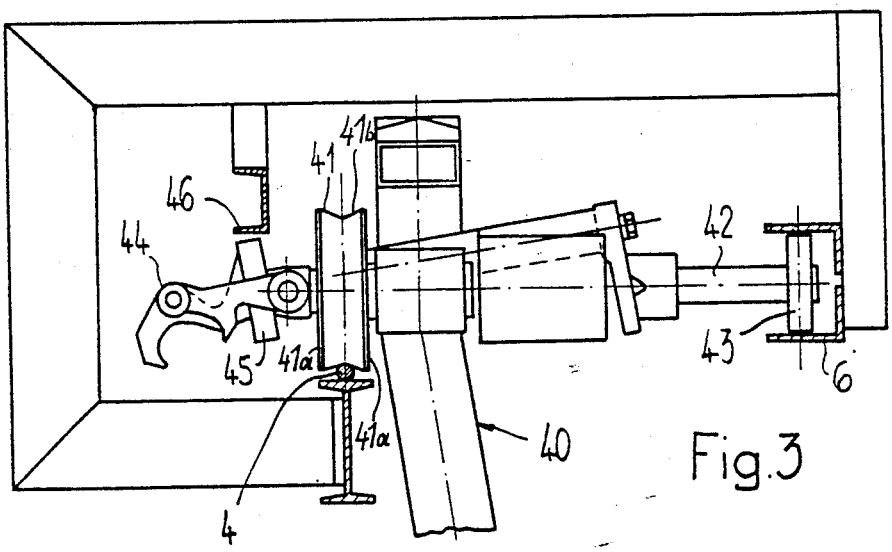
Fig.3
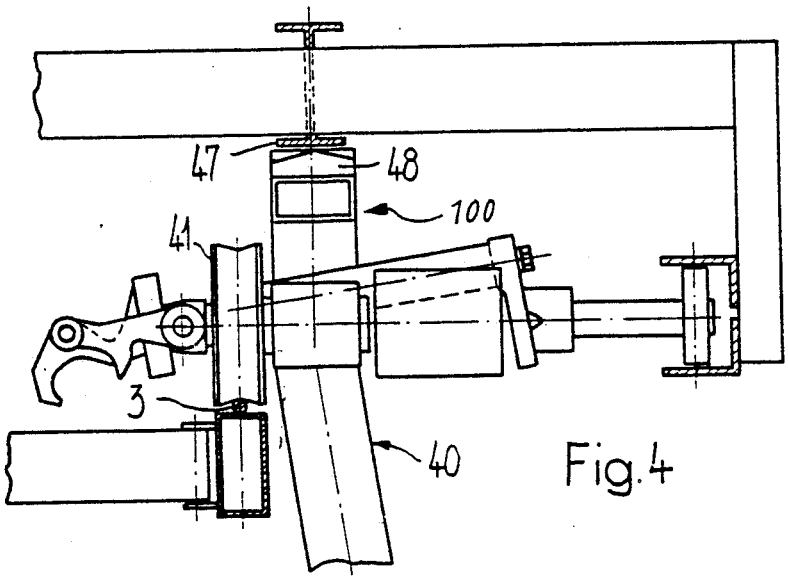
Fig.4
Fig.5a
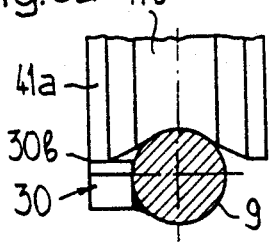
Fig.5b
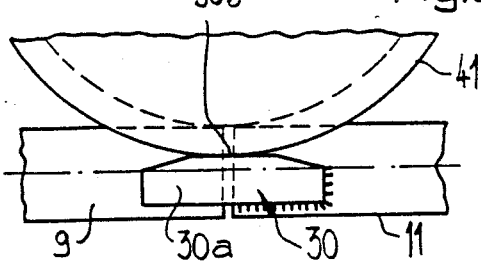

SWITCHING DEVICE FOR AN OVERHEAD CABLE TRANSPORT

This is a continuation of application Ser. No. 07/142,684, filed Jan. 11, 1988, which was abandoned upon the filing hereof.

BACKGROUND OF THE INVENTION

The present invention relates to a new and improved construction of a switching or switch device or arrangement for the station track system of an overhead cable transport installation, typically an aerial cableway.

Generally speaking, the switching device or arrangement for the station track system of an overhead cable transport installation is of the type comprising a primary or main track and a branch or auxiliary track. Each such primary track and branch track possesses at least one respective travel rail for the carriage wheels of the vehicles which are conveyed between respective stations of the overhead cable transport installation. A travel rail section is movable between a travel position and a rest position and an actuation device or actuation means is operatively connected with the movable travel rail section.

The switching or switch devices or arrangements which are positioned at the station track systems of overhead cable transport installations or locations, render it possible to shunt in and shunt out the vehicles which circulatingly or revolvingly travel between the intended destinations or locations, such as typically different stations or terminals of the overhead cable transport installation along a cable conveying path. The shunting in or shuttling in of vehicles can be accomplished either from a vehicle parking track or, in the case of a mid-station or intermediate station, such as one which is located at an intermediate point between the base station or terminal of a mountain and an upper or top station or terminal of the mountain at which there may be employed such overhead cable transport installation, out of a further cable conveying path or conveying system from which the vehicles must be temporarily shunted out. In the case of heretofore known switching or switch devices of this type the travel rail of the branch track is equipped with a movable travel rail section constructed as a tongue member or the like, whereas the travel rail of the primary or main track, as a general rule, is designed as a continuous track structure. In the travel position of the tongue or tongue member, that is to say, when the vehicles should travel through the branch or auxiliary track, the free end of the tongue or tongue member is assigned the task of raising the travel wheels of the vehicles which are to be shunted or directed onto the branch track, to such an extent that the wheel flanks or track rims of the travel wheels of the vehicles can pass over the travel rail of the primary or main track.

What is disadvantageous with such prior art design of switching or switch devices is that the travel surfaces of the tongue end, by virtue of the design of the system, by necessity form a step or shoulder in relation to the travel surfaces of the travel rail upon which the tongue end bears. Apart from the fact that the travel velocity of the vehicles, when passing over such step or shoulder, is undesirably affected, also impact or shock-like motions or blows are imparted to the carriages of the vehicles. These sudden impacts or blows are undesired since they undesirably accelerate or promote the wear of the equipment. In the case of overhead cable transport installations which are used for the conveyance of passengers, wherein the vehicle cabins also travel in a loaded state or condition over the switching or switch tongues, such impacts or blows impair the travel comfort of the passengers. It is worthy of mention that there also exists the danger of derailing of the vehicles since at the corresponding region of the switching device there is usually absent a guide rail for stabilization of the through passing vehicles and the aforementioned impacts or blows therefore can initiate pendulum or swinging motions at the vehicles.

SUMMARY OF THE INVENTION

Therefore with the foregoing in mind it is a primary object of the present invention to provide a new and improved construction of a switching device for a station track system of an overhead cable transport installation which is not afflicted with the aforementioned drawbacks and shortcomings of the prior art constructions.

Another and more specific object of the present invention aims at the provision of a new and improved construction of a switching device for a station track system of an overhead cable transport installation which, while avoiding or at least appreciably minimizing the danger of derailing of the vehicles of the overhead cable transport installation, affords quiet travel of the vehicles.

Yet a further significant object of the present invention is directed to a new and improved construction of a switching device for a station track system of an overhead cable transport installation, typically an aerial cableway, which affords positive switching of the vehicles of such aerial cableway in a safe, reliable and relatively shock-free manner from one desired side track structure to another.

A still further significant object of the present invention aims at the provision of a new and improved construction of a switching device for the station track system of an overhead cable transport installation, which switching device is relatively simple in construction and design, extremely reliable in operation, relatively economical to manufacture, not readily subject to breakdown or malfunction and requires a minimum of maintenance and servicing.

Now in order to implement these and still further objects of the invention, which will become more readily apparent as the description proceeds, the switching or switch device for the station track system of an overhead cable transport installation, as contemplated by the present invention, is manifested by the features that the travel rails of the primary track and the branch track comprise three stationary track sections which terminate in spaced relationship from one another. The travel rails of each primary track and branch track also comprise a respective movable track section. In the travel positions of both of the movable track sections there are operatively interconnected two stationary track sections of the associated track. Additionally, connection means are provided for conjointly moving both of the movable track sections.

With the switching or switch device of the present development the movable track sections of the travel rails come to lie in recesses which are formed between the stationary track sections of the travel rails which terminate in spaced relationship from one another. Furthermore, the movable track sections, at least in their vehicle travel positions, can lie in that plane which is defined by the stationary track sections. In this way there is afforded a quiet travel of the vehicles. Due to the use of the connection means there is also ensured that when one of the movable track sections has departed from a vehicle travel position corresponding to a first position of the switching device, the other movable track section is automatically moved into the vehicle travel position corresponding to the other position of the switching device.

According to a preferred embodiment of the inventive switching device, the movement of the movable track sections occurs in the plane defined by the stationary track sections. To simplify the guiding of the movable track sections it is advantageous to mount the movable track sections so as to be pivotable or swivelable.

In order to be able to equally stabilize the vehicles when travelling over the movable track sections and thus also to additionally prevent the danger of derailing of the vehicles, each track, according to a preferred exemplary embodiment of the inventive switching device, is provided with a guide rail or rail member. The guide rails or rail members extend in a plane which is upwardly elevated or shifted in relation to the travel rails. The guide rail which intersects with a travel rail possesses a portion or section, preferably a tongue or tongue member, which is movable in the plane of the guide rail between two positions, whereas the other guide rail is a continuous rail.

There are advantageously provided further connection means in order to conjointly move the movable portion of the intersecting guide rail with the movable travel rail sections of the travel rails.

As contemplated by a particularly advantageous design of the inventive switching device there are provided means for locking at least the movable travel rail section of the branch track in the travel position. This movable travel rail section of the branch track possesses a curvature or curved configuration. This locking action beneficially serves to absorb as directly as possible the forces resulting from the deflection or turning of the vehicles, so that the actuation means are relieved of loads, in other words need not apply any restraining or retention forces.

A very economical design of the locking means can be realized if, as contemplated by the invention, such constitute self-acting locking means. These self-acting locking means specifically function in such a manner that they not only automatically assume the locking position, but also automatically depart from such locking position under the influence of a switching force which is effective at the side of the actuation operation.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 3 is a vertical sectional view of the switching device depicted in FIG. 1, taken substantially along the line III—III thereof;

FIG. 4 is a vertical sectional view of the switching device depicted in FIG. 2, taken substantially along the line IV—IV thereof;

FIG. 5*a* illustrates a detail of the travel rail of the branch track in cross-sectional illustration; and FIG. 5*b* illustrates a detail of such travel rail in elevational view.

DETAILED DESCRIPTION OF THE PREFERRED EMBODIMENTS

Describing now the drawings, it is to be understood that to simplify the illustration thereof, only enough of the construction of the switching or switch device and related structure of the overhead cable transport installation, here shown for instance as an aerial cableway, has been illustrated therein as are needed to enable one skilled in the art to readily understand the underlying principles and concepts of the present invention. The aerial cableway can be used, as desired, for transporting passengers or goods or materials. Typically, such aerial cableways are designed in the form of gondola or chair lifts, especially when conveying passengers between desired destinations or terminals, such as stations located along a conveying path, usually along the face of a mountain. However, the vehicles of the aerial cableway need not necessarily be constituted by gondolas or chairs of chairlifts or equivalent structure, but may comprise any other suitable conveyance structure.

Figure 1:
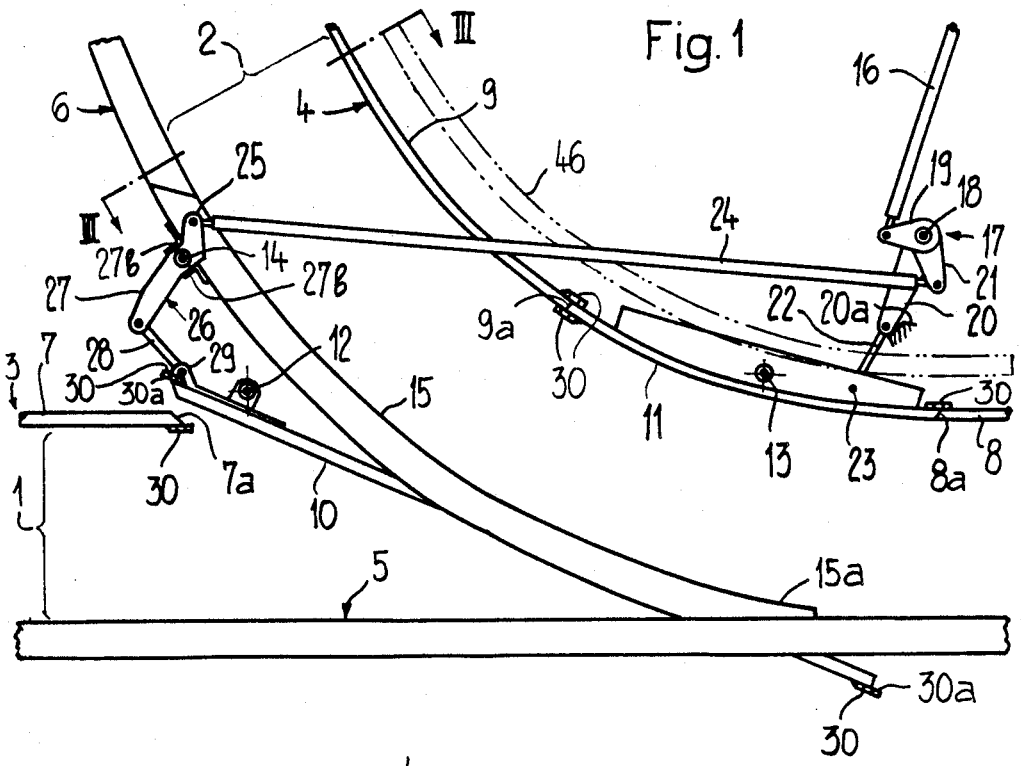
FIG. 1 schematically illustrates in top plan view the switching or switch device of the present invention in a vehicle deflection or turning position corresponding to the normal vehicle travel operation.
Figure 2:
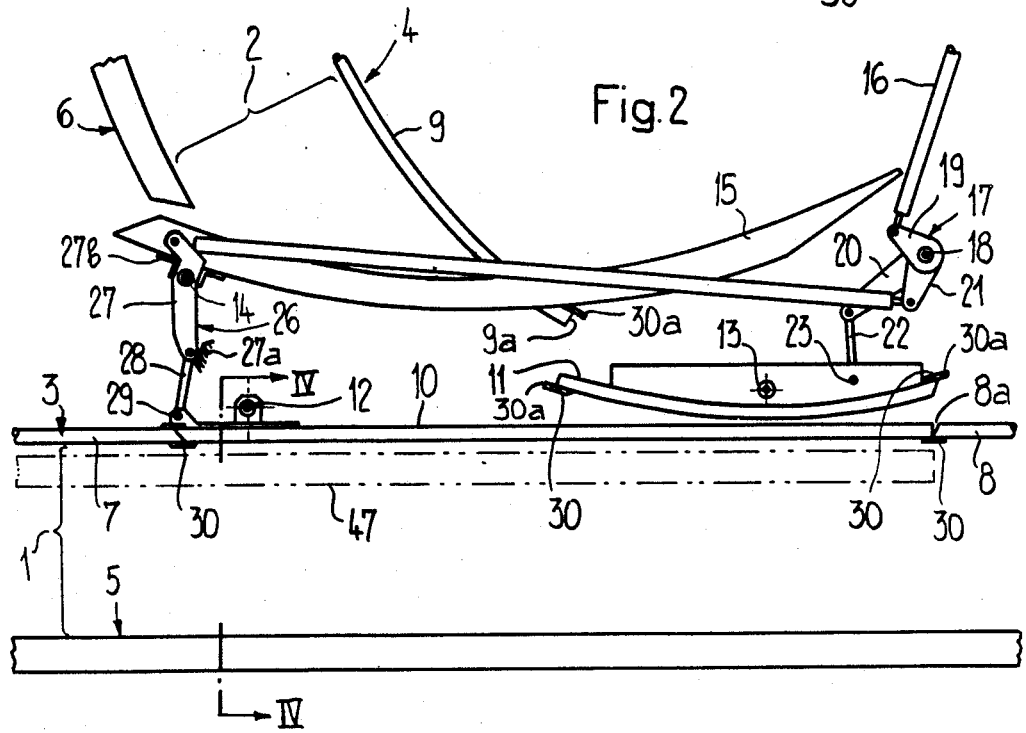
FIG. 2 illustrates in top plan view, corresponding to the showing of FIG. 1, the switching device located in a position affording straight ahead travel of the vehicles.

In FIGS. 1 and 2, the switching or switch device of the station track system of the overhead cable transport installation, typically the aerial cableway, as depicted therein, will be seen to comprise a substantially linear track, here designated as a primary or main track 1 and a curved or curvilinear track, here designated as a branch or auxiliary track 2. In the exemplary embodiment under discussion, there will be assumed, strictly by way of example and not limitation, that the curved or curvilinear branch track 2 constitutes the usual direction of travel for the vehicles along the cable conveying path, whereas the primary or main track 1 serves, again strictly by way of example, as a parking section or path for the vehicles.

Each of the tracks or track means 1 and 2 comprises an associated travel rail or rail member 3 and 4 respectively, as well as a guide rail or rail member 5 and 6, respectively. The travel rails 3 and 4 and the related guide rails 5 and 6 of each of the tracks 1 and 2 define mutually parallel planes, wherein the guide rail plane is disposed above the travel rail plane, as will be evident from the illustration of FIGS. 3 and 4. The travel rails 3 and 4 comprise three stationary travel rail sections or portions 7, 8 and 9, whose ends 7*a*, 8*a* and 9*a* respectively, are located so as to terminate in spaced relationship from one another, as will be particularly evident by referring to FIGS. 1 and 2. Moreover, movable travel rail sections 10 and 11 are operatively associated with the travel rails 3 and 4, respectively. These movable travel rail sections 10 and 11 are each pivotable between a vehicle travel position and a rest or ineffectual position about related pivot axes defined by pivot shafts 12 and 13, respectively, disposed substantially perpendicular to the plane of the switching or switch device.

Continuing, it will be recognized that in the vehicle travel position of the curved movable travel rail section 11, as depected in FIG. 1, such curved movable travel rail section 11 operatively interconnects with one another the ends 8*a* and 9*a* of the stationary travel rail sections 8 and 9, respectively. On the other hand, in the vehicle travel position, as depicted in FIG. 2, of the substantially linear movable travel rail section 10 the latter operatively connects with one another the ends 8*a* and 7*a* of the stationary travel rail sections 8 and 7, respectively. By again reverting to FIG. 1 there will be recognized the rest or ineffectual position of the substantially linear movable travel rail section 10 and by inspecting FIG. 2 there will be evident the rest or ineffectual position of the curved movable travel rail section 11. In any event, the movable travel rail sections 10 and 11 are movable in the plane defined by the stationary travel rail sections 7, 8 and 9.

While it will be observed that the guide rail or rail member 5 constitutes a continuous stationary rail structure, the guide rail or rail member 6 which intersects or crosses the travel rail or rail member 3 possesses a rail portion or region 15 constructed as a tongue or tongue member. This tongue-like portion or region 15 is pivotable or swivelable about a pivot axis defined by a pivot shaft 14 which extends perpendicular to the plane of the guide rails 5 and 6. This tongue-like portion or region 15 can be pivoted out of the vehicle travel position depicted in FIG. 1 in which its free tongue end 15*a* bears against or contacts the guide rail 5 into a rest or ineffectual position as depicted in FIG. 2, in which now the primary or main track 1 has been conditioned, by the pivoted-away tongue-like portion 15, to allow the primary or main track 1 to receive vehicles for travel thereover.

The movable, for instance pivotal track sections 10, 11 and 15 are conjointly movable between both of the aforedescribed positions by the action of an actuation rod or rod member 16 or equivalent structure and are operatively interconnected with one another for the conjoint movement thereof in the following manner:

The movable actuation rod or rod member 16, which can be manually operated or motor driven by a suitable drive motor, engages with one arm or arm member 19 of a triple-arm lever or lever structure, generally designated in its entirety by reference numeral 17. This triple-arm lever or lever structure 17 is pivotably mounted at the pivot means or location 18 and contains the further arms or arm members 20 and 21. The arm or arm member 20 is connected by means of a guide member or guide 22 at a connection location 23 with the movable travel rail section 11 and forms in conjunction with this guide member or guide 22 a toggle lever or link or joint structure. The arm or arm member 21 is connected by means of a guide rod 24 or the like with the arm or arm member 25 of a double-arm lever 26. This double-arm lever 26 engages by means of an arm or arm member 27 thereof as well as a guide or guide member 28 at location 29 with the movable travel rail section 10. The arm 27 and the guide or guide member 28 collectively again form a toggle lever or link or joint structure. The double-arm lever or lever member 26 which likewise is pivotable about the pivot axis defined by the pivot shaft 14 of the guide rail section 15, is rigidly connected with the guide rail section 15 so as not to be rotatable in relation thereto by means of further connection elements or connection means 27*b*.

The connection of the movable rail sections 10, 11 and 15 is analogously selected such that the movable rail sections 11 and 15 can jointly move into the vehicle travel position when the movable rail section 10 is moved out of the vehicle travel position into the rest or ineffectual position.

As will be further evident by referring to FIGS. 1 and 2, the vehicle travel positions of the travel rail sections 10 and 11 are defined or delimited by abutment or stop members 30*a* which are formed by bridge or bridging elements 30 or equivalent structure rigidly secured at the ends of the movable travel rail sections 10 and 11. Although the operation of the bridge or bridging elements or parts 30 will be explained more fully hereinafter, it is remarked at this time that the abutments or stops 30*a* which laterally protrude past these travel rail sections 10 and 11 coact with the stationary rail sections 7, 8 or 9, 8, as the case may be, which are to be interconnected in each case. Advantageously, there is also defined the travel position of the movable guide rail section 15, specifically in that this movable guide rail section 15 is clamped or biased against the guide rail or rail member 5. This can be beneficially achieved without the need for resorting to any auxiliary expedients or aids in that the movable guide rail section 15 contacts the guide rail or rail member 5 as soon as the toggle link or joint structure 20, 22 has assumed the extended position thereof.

In order to lock the travel rail sections 10 and 11 in their respective travel position the positions of the arms or arm members 20 and 27, which correspond or are correlated to the travel positions of the travel rail sections 10 and 11, have operatively associated therewith the abutments or stop members 20*a* and 27*a*, respectively. Since these abutments or stop members 20*a* and 27*a* are located, in relation to the rest position of the participating toggle link or joint structures 20, 22 and 27, 28, respectively, to the far side of the extended positions, these abutments or stop members 20*a* and 27*a* prevent pivotal or swivel motions of the related movable travel rail sections 10 and 11 in the direction of the rest position under the action of forces laterally effective at such travel rail sections 10 and 11. Specifically, the abutment or stop member 20*a* precludes a pivoting or swivelling of the travel rail section 11 in the counterclockwise direction under the influence of the centrifugal force which is exerted by a vehicle upon such travel rail section 11 when the vehicle negotiates the path between the pivot shaft 13 and the rail end 9*a*. Of course, the abutments or stop members 30*a* prevent a pivoting or swivelling of the travel rail section 11 in the clockwise direction during vehicle travel along the path between the rail end 8*a* and the pivot shaft 13. In any event, the toggle link or joint structures in conjunction with the abutment or stop members form self-acting locking means which only can be released by moving the actuation rod or element 16 or equivalent actuation facility.

In FIGS. 3 and 4 reference numeral 40 generally designates a suspension system of a vehicle and which is supported upon the travel rail 4 or the travel rail 3, as the case may be, by the related carriage which is here only shown generally represented by the travel wheel or wheel member 41 thereof. The suspension system or suspension means 40 possesses a cantilevered portion or cantilever arm 42 at the free end of which there is rotatably mounted a guide wheel or wheel member 43 for rotation about an axis extending substantially parallel to the rotational axis of the travel wheel 41. This rotatable guide wheel 43 engages in the guide rail or rail member 6 which is advantageously constructed as a substantially U-shaped profile or structural member. By means of the guide rail or rail member 6 there are thus advantageously prevented to both sides pendulum or swinging motions of the suspension system 40 about its lengthwise axis.

Reference numeral 44 designates a suitable cable clamp or the like which is affixed to the suspension system or suspension means 40 and carries a roll or roller member 45 which, in turn, coacts with a curved holddown rail or rail member 46 which is continuous at the region of the switching device. The curved holddown rail 46, which for the purpose of affording clarity in illustration of FIG. 2 has been conveniently omitted, has been depicted with chain-dot lines in FIG. 1 and forms, as will be apparent from the illustration of FIG. 1, a further rail of the branch track 2. The curved holddown rail 46 in coaction with the roll or roller 45 insures that the travel wheel 41 remains at its travel surface 41*b* in contact with the travel rail 4. This travel surface 41*b* of the travel wheel 41 is recessed or inset and it is bounded at both sides by the associated wheel flanks 41*a*, as best seen by referring to FIGS. 4 and 5*a*. The curved holddown rail 46, instead of possessing a small radius of curvature, could possess a radius of curvature which is approximately equal to that of the curved travel rail 4.

In FIG. 4 reference numeral 47 designates a further holddown rail which coacts with a friction element, here shown as a friction shoe 48 secured to the vehicle carriage, generally indicated by reference numeral 100 in such FIG. 4. This further holddown rail or rail member 47 is substantially straight or linear and extends, as will be apparent from the illustration of FIG. 2 (in FIG. 1 for clarity and ease of representation thereof the same has been omitted) as part of the primary or main track 1 leading to the parking track and at that location replaces the holddown rail 46 while accomplishing the same function or action.

From the illustration of FIGS. 5*a* and 5*b* there will be recognized the operation of the bridge or bridging elements 30. Each bridge or bridging element 30 comprises a related travel surface 30*b* which, in relation to the highest point or apex of the related travel rail profile, here the depicted travel rail section 9, is downwardly offset or shifted by an amount which essentially corresponds to the radius difference between the lowest point of the travel rail profile of the travel surface 41*b* and the rim 41*a* of the travel wheel 41. If any given one of the travel wheels 41 travels over the joint between two travel rail sections, which has been represented in FIG. 5*b* by the travel rail sections 9 and 11, then the travel surface 30*b* provides the supporting action for the travel wheel 41 at the region of the wheel flanks 41*a*. Of course, bridging elements 30 provided with travel surfaces 30*b* can be provided for both wheel flanks 41*a* of each travel wheel 41, as such will be apparent from the illustrations of FIGS. 1 and 2.

Since the travel rail sections 10 and 11, in their respective travel positions, are located in the planes defined by the travel rails 3 and 4, respectively, it is unnecessary during vehicle travel through these travel rail sections 10 and 11 to overcome an elevational difference nor do there arise impacts or blows when the vehicle travels over the rail joints by virtue of the provision of the bridge or bridging elements 30. Accordingly, the construction of the switching or switch device as contemplated by the present invention not only avoids all possible danger of vehicle derailment, but furthermore it also ensures for quiet running or travel of the vehicles.

The inventive switching or switch device also can be designed such that the guide rails are located at the turning or deflection side of the travel rail or in comparison thereto exhibit a smaller radius of curvature in the curved branch track. This is then necessary when the vehicles move through the stationary track system with inwardly turned or directed suspension systems. It is however to be understood that the switching device of the invention allows the vehicles to travel in both directions independent of the position of the guide rails.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A switching device for a station track system of an overhead cable transport installation containing vehicles having carriage wheels, said vehicles being of the type in which each has to one side of its said carriage wheel load suspension means including an arm extending axially of said wheel and having a guide wheel on the end of that arm, said switching device comprising:

a primary track at which travel the vehicles;

a branch track at which travel the vehicles and which branches off from said primary track;

said primary track being provided with at least one travel rail for the carriage wheels of the vehicles;

said branch track being provided with at least one travel rail for the carriage wheel of the vehicles;

said travel rails of both said primary track and said branch track comprising three stationary track sections terminating in spaced relationship from one another;

each said primary track and branch track being provided with a respective movable track section;

each said movable track section being movable between an operative travel position and an operative rest position;

a different selected two of said three stationary track sections being operatively interconnected with one another in the travel positions respectively by different ones of said movable sections;

switching means for conjointly moving both of said movable track sections to disrupt one of said tracks and to complete the other by switching both of said movable sections when either is in said operative travel position and the other is in said inoperative rest position respectively to said inoperative rest position and said operative travel position; and respective guide rails for and spaced from said travel rails to receive said guide wheel, the space between the said respective guide and travel rails being open along their length to accommodate said suspension means as a said vehicle travels on either of said travel rails and is guided by the respective guide rail.

2. The switching device as defined in claim 1, wherein:

said means for conjointly moving both movable track sections comprise connection means connecting said sections.

3. The switching device as defined in claim 1, wherein:

said three stationary track sections define a plane; and means for mounting the movable track sections of the travel rails for movement in substantially said plane of said three stationary track sections.

4. The switching device as defined in claim 3, wherein:

said mounting means mount said movable track sections for pivotal movement.

5. A switching device as in claim 1 including holddown means for holding said carriage wheels in contact with both of said travel rails.

6. A switching device as in claim 1 wherein each said guide rail is U-shaped with upper and lower flanges and an open side facing toward said space for receiving said guide wheel between and in contact with said flanges.

7. A switching device as in claim 1 wherein one of said guide rails has a movable section which is moved by said switching means between an operable guide position and an inoperative rest position conjointly with the respective movable travel rail section, and wherein said travel rails are in one plane and the guide rails are in a second plane which is parallel to but spaced above said one plane for allowing unhindered movement of all of said movable sections of said travel and guide rails in their respective planes.

8. A switching device as in claim 7 wherein the other guide rail is continuous.

9. A switching device as in claim 8 wherein all of said movable sections of said travel and guide rails have separate respective pivot axes perpendicular to said planes and said switching means pivots each movable section at one time or another into its said operable position so as to effect a continuous rail by means of only the pivoted section itself.

10. A switching device for a station track system of an overhead cable transport installation containing vehicles having carriage wheels, comprising:

a primary track at which travel the vehicles;

a branch track at which travel the vehicles;

said primary track being provided with at least one travel rail for the carriage wheels of the vehicles;

said brnach track being provided with at least one travel rail for the carriage wheels of the vehicles;

said travel rails of both said primary track and said branch track comprise three stationary track sections terminating in spaced relationship from one another;

each said primary track and branch track being provided with a respective movable track section;

each said movable track section being movable between a travel position and a rest position;

two of said stationary track sections being operatively interconnected with one another in the travel position of both movable track sections;

means for conjointly moving both of said movable track sections;

each vehicle comprising a vehicle carriage having a carriage cantilever means;

a respective guide rail for the carriage cantilever means provided for each said primary track and said branch track;

said travel rails defining a plane;

said guide rails extending in a plane which is upwardly elevated with respect to the plane of the travel rails;

one of said guide rails intersecting the travel rail of the primary track;

said one guide rail which intersects the travel rail of the primary track possessing a guide rail portion movable between two predeterminate positions; and the other one of said guide rails constituting a continuous rail.

11. The switching device as defined in claim 10, wherein:

said movable guide rail portion of said one guide rail comprises a tongue member.

12. The switching device as defined in claim 10, further including:

means for conjointly moving the movable guide rail portion of said one guide rail conjointly with the movable track sections of the travel rails.

13. The switching device as defined in claim 12, wherein:

said branch track possesses a curvature;

a predeterminate one of said guide rails extending along an outer side with respect to the travel rail of said branch track;

said travel rail of said branch track has a radius of curvature;

a continuous stationary and curved holddown rail means;

said continuous stationary and curved holddown rail means having a radius of curvature which is approximately equal to the radius of curvature of the travel rail of the branch track; and a further stationary linear holddown rail means extending above the plane of the guide rails and between the travel rail and the guide rail of the primary track.

14. The switching device as defined in claim 12, wherein:

said branch track possesses a curvature;

a predeterminate one of said guide rails extending along an outer side with respect to the travel rail of said branch track;

said travel rail of said branch track has a radius of curvature;

a continuous stationary and curved holddown rail means;

said continuous stationary and curved holddown rail means having a radius of curvature which is smaller than the radius of curvature of the travel rail of the branch track; and a further stationary linear holddown rail means extending above the plane of the guide rails and between the travel rail and the guide rail of the primary track.

15. A switching device for a station track system of an overhead cable transport installation containing vehicles having carriage wheels, comprising:

a primary track at which travel the vehicles;

a branch track at which travel the vehicles;

said primary track being provided with at least one travel rail for the carriage wheels of the vehicles;

said branch track being provided with at least one travel rail for the carriage wheels of the vehicles;

said travel rails of both said primary track and said branch track comprising three stationary track sections terminating in spaced relationship from one another;

each said primary track and branch track being provided with a respective movable track section;

each said movable track section being movable between an operative travel position in which the movable section completes its respective travel rail by extending between a respective two of said stationary track sections and an inoperative rest position in which the movable section is disconnected from all of said stationary track sections;

a different two of said stationary track sections being operatively interconnected with one another in the respective travel positions of said movable track sections;

means for conjointly moving both of said movable track sections;

said travel rails defining a plane; and means for pivotably mounting each of said movable track sections for pivotal motion about separate respective pivot axes extending substantially perpendicular to said plane of the travel rails, said pivot axes being displaced from said travel rails and said movable sections being so connected to said moving means and said pivot axes being so disposed that when either one of said movable sections is in its said travel positions, the other is in its said inoperative rest position so as to be disconnected from all of said stationary track sections as aforesaid.

16. A switching device for a station track system of an overhead cable transport installation containing vehicles having carriage wheels, comprising:

a primary track at which travel the vehicles;

a branch track at which travel the vehicles;

said primary track being provided with at least one travel rail for the carriage wheels of the vehicles;

said branch track being provided with at least one travel rail for the carriage wheels of the vehicles;

said travel rails of both said primary track and said branch track comprising three stationary track sections terminating in spaced relationship from one another;

each said primary track and branch track being provided with a respective movable track section;

each said movable track section being movable between an operative travel position in which the movable section completes it respective travel rail and an inoperative rest position in which the movable section disrupts its respective travel rail;

two of said stationary track sections being operatively interconnected with one another in the travel position of both movable track sections;

means for conjointly moving both of said movable track sections;

said branch track having a predeterminate curvature; and means for locking in a vehicle travel position at least the movable track section of the branch track having the predeterminate curvature and concurrectly locking in said inoperative rest position at least the movable track section of the primary track.

17. The switching device as defined in claim 16, wherein:

said locking means comprise self-acting locking structure.

18. The switching device as defined in claim 17, further including:

actuation means for operating said means for conjointly moving both of the movable track sections;

said means for conjointly moving both of the movable track sections comprising toggle means for operatively connecting said actuation means with one of said movable track sections of one of said tracks;

said toggle means being capable of assuming an extended position;

said extended position of said toggle means being located between terminal positions corresponding to the travel position and the rest position of said one movable track section;

at least two abutment means for defining the travel position of said one movable track section; and one of said two abutment means being effective at the toggle means and the other of said two abutment means being effective between said one movable track section and one of the interconnected stationary track sections.

19. The switching device as defined in claim 18, wherein:

said one movable track section comprises the movable track section of the branch track.

20. The switching device as defined in claim 18, further including:

a rail joint formed between the movable track section and the stationary track section of each travel rail;

at least one bridging element operatively associated with each rail joint between the movable track section and the stationary track section of each travel rail;

said at least one bridging element possessing a travel surface;

said travel rails each possessing a travel surface; and said at least one bridging element being located beneath the travel surfaces of the travel rails.

21. The switching device as defined in claim 10, wherein:

said at least one bridging element comprises a plurality of bridging elements; and said plurality of bridging elements forming abutments for defining the travel positions of both movable track sections.

22. A switching device for a track system of an overhead cable transport installation containing vehicles, comprising:

a first track upon which travel the vehicles;

a second track upon which travel the vehicles;

said first track being provided with at lesat one travel rail for the vehicles;

said second track being provided with at least one travel rail for the vehicles;

said travel rails of both said first track and said second track comprising three stationary track sections terminating in spaced relationship from one another;

each said first track and second track being provided with a respective movable track section;

each said movable track section having its own separate pivot axis and being pivotable about its axis between an operative travel position in which the pivotable section itself effects continuity of its respective travel rail and an inoperative rest position in which the pivotable section disrupts the continuity of its respective travel rail;

a first two predeterminate stationary track sections of said three stationary track sections having their continuity completed solely by one of said pivotable track sections when in its travel position;

a second two predeterminate stationary track sections of said three stationary track sections having their continuity completed solely by the other one of said pivotable track sections when in its travel position; and switching means for concurrently pivoting both of said pivotable track sections about their respective pivot axes to disrupt one of said tracks and to complete the continuity of the other only by switching both of said pivotable sections when either is in its said travel position and the other is in its said rest position respectively to rest and travel positions.

23. A switching device as in claim 22 for use with said vehicle of the type in which each has to one side of its said carriage wheel load suspension means including an arm extending axially of said wheel and having a guide wheel on the end of that arm, said switching device further including:

a pair of guide rails respectively associated with said travel rails for accommodating said guide wheels and guiding said vehicles;

one of said guide rails being continuous and the other including a pivotable section which is pivoted by said switching means concurrently with the pivotable section of the associated travel rail between an operative guide position and an inoperative rest position;

said travel rails being in one plane and the guide rails in a second plane which is parallel to but spaced above said one plane for allowing unhindered pivoting of all of said pivotable sections of said travel and guide rails in their respective planes.

24. A switching device for a staion track system of an overhead transport installation containing vehicles having carriage wheels and to one side thereof load suspension means including guide wheels, comprising:

first and second diverging tracks for said vehicles and between which said vehicles are to be switched, each track having a respective set of spaced travel and guide rails for respectively accommodating said carriage and guide wheels, each of the travel rails and one only of the guide rails having movable sections which are movable into and out of alignment with their respective rails, and switching means for concurrently moving all three of said movable sections to disrupt either one of said tracks and to complete the other with both travel and guide rails by switching both of the travel rail movable sections when either is aligned with its respective travel rail to a position which is unaligned therewith and concurrently switching said movable guide rail section between positions of alignment and non-alignment with its guide rail, said spaced travel and guide rails having between them along their length an open space sufficient to accommodate said load suspension means when said vehicles travel on either of said travel rails and are guided by said guide rails.

25. A switching device as in claim 24 wherein said travel rails are in one plane and the guide rails are in a second plane which is parallel to but spaced above said one plane for permitting unhindered movement of all of said movable sections of said travel and guide rails in their respective planes.

26. A switching device as in claim 24 wherein all of said movable sections of said travel and guide rails have separate respective pivot axes and said switching means pivots each movable section at one time or another into said alignment with its respective rail so as to effect a continuous rail by means of only the pivoted section itself.

27. A switching device as in claim 24 wherein each of said guide rails is U-shaped with upper and lower flanges and an open side facing toward its respective travel rail for receiving said guide wheels between and in contact with said flanges.

28. A switching device as in claim 24 including hold-down means for holding said carriage wheels in contact with both of said travel rails.

* * * * *